US007265722B2

(12) United States Patent
Liu et al.

(10) Patent No.: US 7,265,722 B2
(45) Date of Patent: Sep. 4, 2007

(54) ANTENNA STRUCTURE

(75) Inventors: I-Ru Liu, Taipei (TW); Hong-Kun Tyan, Dasi Township, Taoyuan County (TW)

(73) Assignee: Accton Technology Corporation, Hsinchu (TW)

( * ) Notice: Subject to any disclaimer, the term of this patent is extended or adjusted under 35 U.S.C. 154(b) by 39 days.

(21) Appl. No.: 11/291,971

(22) Filed: Dec. 2, 2005

(65) Prior Publication Data

US 2006/0250307 A1 Nov. 9, 2006

(30) Foreign Application Priority Data

May 5, 2005 (TW) ..... 94114548 A

(51) Int. Cl.
*H01Q 1/24* (2006.01)

(52) U.S. Cl. ..... 343/702; 343/846

(58) Field of Classification Search ..... 343/702, 343/700 MS, 846

See application file for complete search history.

(56) References Cited

U.S. PATENT DOCUMENTS 6,072,434 A * 6/2000 Papatheodorou ..... 343/700 MS
6,801,166 B2 * 10/2004 Mikkola et al. ..... 343/700 MS
2005/0225484 A1 * 10/2005 Kuramoto ..... 343/700 MS

* cited by examiner

*Primary Examiner*—Hoang V. Nguyen
(74) *Attorney, Agent, or Firm*—Rosenberg, Klein & Lee

(57) ABSTRACT

An antenna structure is proposed in the present invention. It includes a radiative element having at least two ends. One end of the radiative element has a grounding element connected to a ground plane. Another end of the radiative element has a feed element connected to a transmission line. The feed element is disposed diagonally relative to the grounding element. In this way, the present invention increases the bandwidth of the antenna and improves its functionality. Therefore, the antenna of the present invention is more convenient when in use.

13 Claims, 7 Drawing Sheets

ANTENNA STRUCTURE

BACKGROUND OF THE INVENTION

1. Field of the Invention

The present invention is related to an antenna structure, and more particularly, to an antenna having wider bandwidth.

2. Description of Related Art

With rapid progress of Internet technologies, plenty of services related to Internet, including the Internet services for work and daily life, have been provided for people nowadays. In the initial stage, the networks of Internet are all wired. Users need to deploy network cables before connecting to Internet. That is very inconvenient, especially when there are a lot of people who need to connect to Internet together. For example, in offices or schools, deploying networks cables needs a lot of time and labor. Besides, the networks cables deployed are usually very close and numerous, usually like spider's webs. The networks cables are hard to be put in order and usually do not have a good appearance. However, with occurrence of wireless local area networks (LANs), the drawbacks of the network deployment mentioned above are removed gradually. In the wireless LAN technologies, data are transferred in a wireless manner via antennas. Without disposition of antennas, wireless network devices, such as Access Points (AP) or client of networks, cannot transmit or receive data. Hence, antennas play an important role in the wireless LAN technologies.

Conventional inverted F antennas have a compact size and a simple structure and are easy to design. Hence, in recent years, inverted F antennas are applied extensively to various communication systems and products. In the wireless LAN technologies, inverted F antennas are often used. In order to adapt to different countries' wireless LAN standards, which use different frequency bands, the inverted F antennas used in wireless LANs are designed to occupy different frequency bands accordingly, such as 5.15-5.35 GHz or 5.47-5.725 GHz.

However, the frequency bands of the inverted F antennas are very narrow. For a user who goes aboard frequently and needs to connect to Internet via wireless LANs, he usually needs to change antennas properly to adapt to local frequency band requirements because the frequency bands used for wireless LANs in different countries are usually different. The user can access the local wireless LANs only when he uses a proper antenna. If he doesn't do so, he cannot access the local wireless LANs even if he stays in a place with wireless LAN services. That is very inconvenient for people who usually go aboard.

Conventionally, if an inverted F antenna's frequency band for data transmission needs to cover multiple frequency bands used in different areas, for example, ranging from 5.15 GHz to 5.825 Ghz or larger, the design difficulty will increase considerably due to the structural limitation of the inverted F antenna.

Therefore, the present invention provides an antenna structure, especially suitable to be applied for embedded antennas of AP. It has wider bandwidth and its frequency band sufficiently covers the frequency band used in Japan and Europe and the Federal Communications Commission (FCC) frequency band used in United States, i.e. ranging from 4.9 GHz to 5.85 GHz or 5.9 GHz. In this way, the present invention increases the applicable area and convenience for users and thus resolves the problems of the prior art mentioned above.

SUMMARY OF THE INVENTION

An objective of the present invention is to provide an antenna structure having wider bandwidth for reception or transmission of Internet data to improve the convenience.

Another objective of the present invention is to provide an antenna structure, which not only has wider bandwidth but also remains the gain.

Still another objective of the present invention is to provide an antenna structure that has a simple structure and manufacturing process and low cost.

For achieving the objectives above, the present invention provides an antenna structure, including a radiative element, a grounding element and a feed element. The radiative element has at least two ends. The grounding element has one end connected to one of the two ends of the radiative element and another end connected to a ground. And the feed element has one end connected to another one of the two ends of the radiative element and another end connected to a transmission line, wherein the feed element is disposed diagonally relative to the grounding element.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
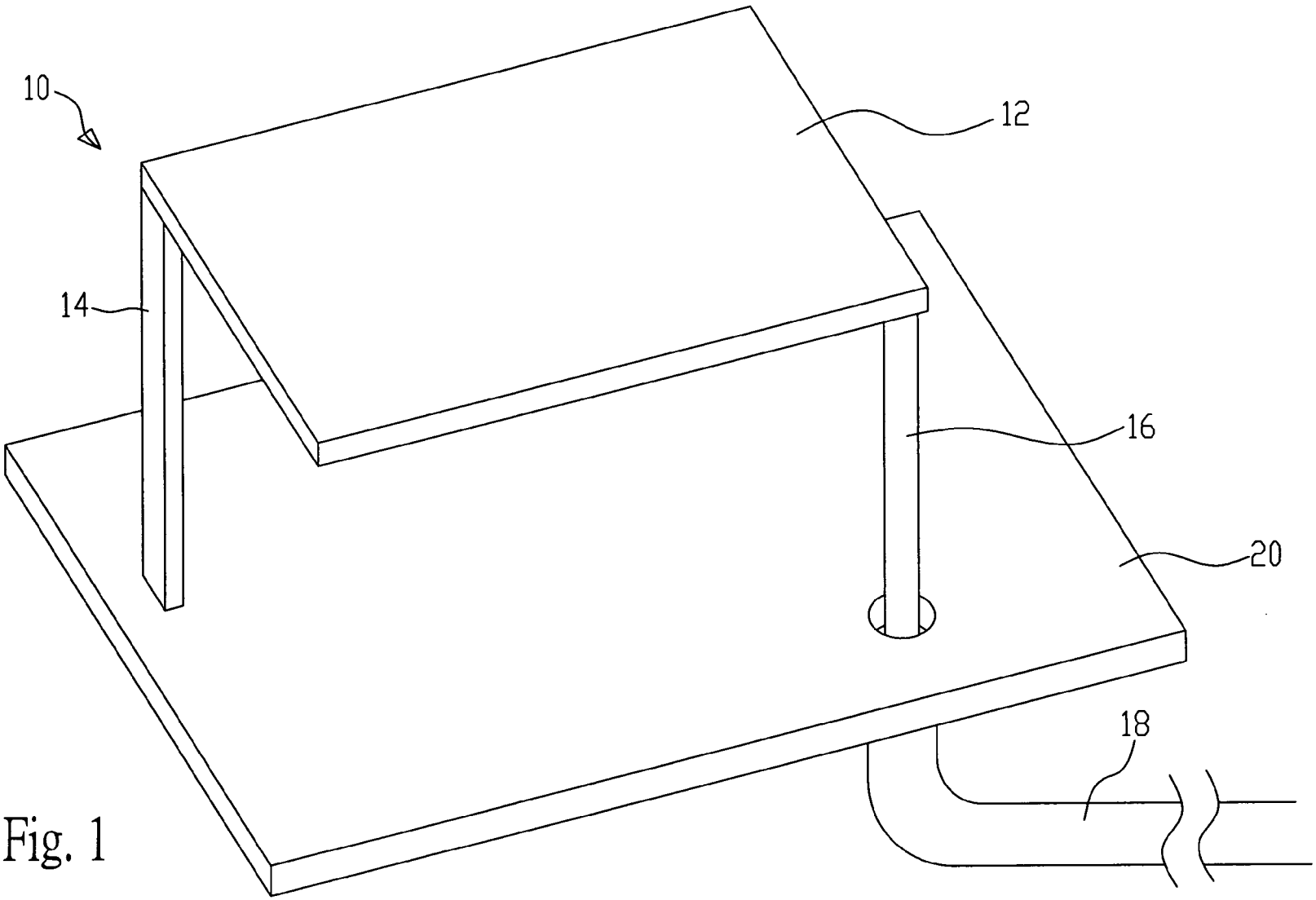
FIG. 1 is an elevation view of a preferred embodiment in accordance with the present invention.

Reference is made to FIGS. 1, 2A, 2B and 2C, which are respectively an elevation view, a front view, a side view and an upward view in accordance with a preferred embodiment of the present invention. As shown in the figures, the antenna 10 of the present invention includes a radiative element 12, a grounding element 14 and a feed element 16. Therein, the radiative element 12 is the main body of the antenna 10, which is used to receive and transmit signals. The radiative element 12 at least has two ends. One end of the radiative element 12 is connected with one end of the grounding element 14. The other end of the grounding element 14 is connected to a ground plane 20. The other end of the radiative element 12 is connected with one end of the feed element 16. The feed element 16 is disposed diagonally relative to the grounding element 14.

The feed element 16 is formed with a cylindrical shape. It can also be formed as a strip. One end of the feed element 16 is connected to the radiative element 12 and the other end is connected to a specific transmission line, such as a coaxial cable 18, or a transmission line of printed circuit boards (PCBs). Thus, on one hand, the feed element 16 is used to feed signals into the radiative element 12 and radiate the signals via the radiative element 12. On the other hand, the feed element 16 is used to transmit received signals to a processing unit (not shown), which will process the signals after receiving them. The radiative element 12 and the ground plane 20 are separated by air. An auxiliary supporting element (not shown) can be used to support the radiative 12. The auxiliary supporting element should be made of a material with a dielectric constant lower than 1.2 and a dissipation factor lower than 0.01, such as foam.

Figure 2A:
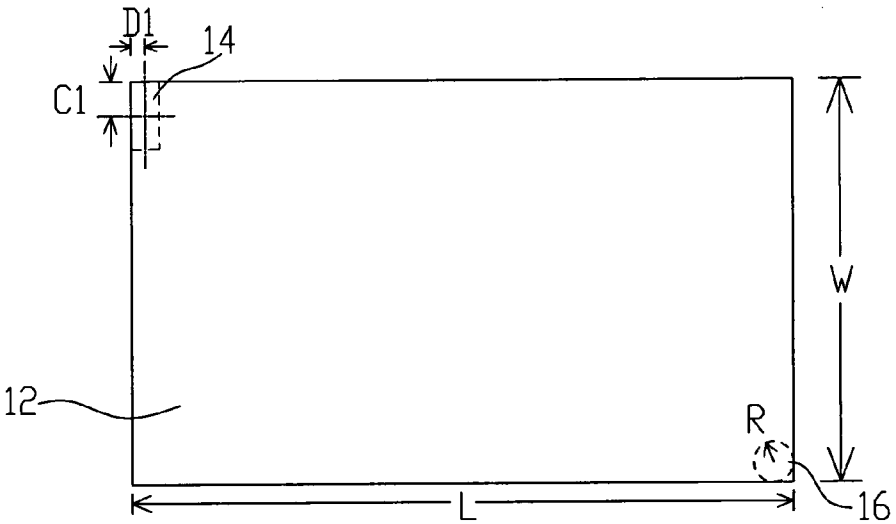
FIG. 2A is a front view of a preferred embodiment in accordance with the present invention.
Figure 2B:
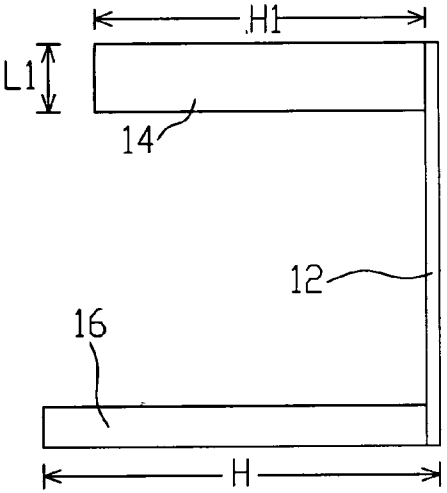
FIG. 2B is a side view of a preferred embodiment in accordance with the present invention.
Figure 2C:
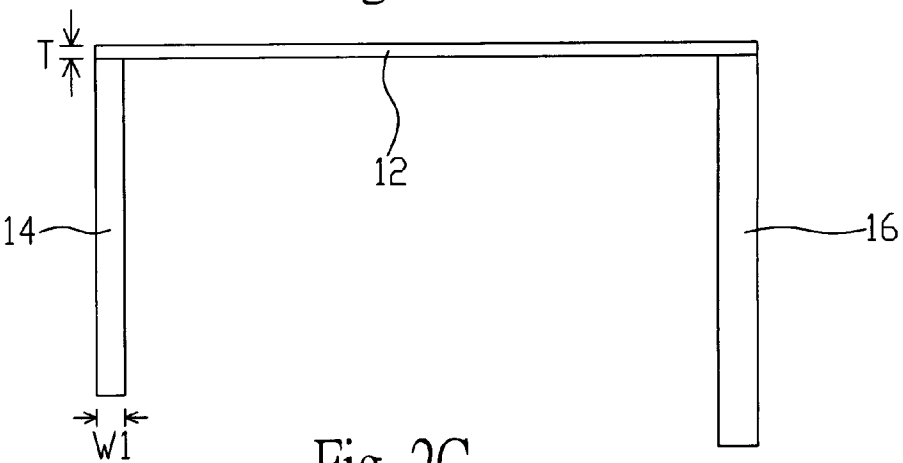
FIG. 2C is a upward view of a preferred embodiment in accordance with the present invention.

Reference is made to FIGS. 2A-C. The grounding element 14 of the present invention is preferred to connect to one end of the radiative element 12. The end of the grounding element 14 connected to the radiative element 12 has a length C1 and a width D1. The length C1 is one half of the normal length L1 of the grounding element 14 while the width D1 is one half of the normal width W1 of the grounding element 14. The wider side of the grounding element 14 is arranged along the narrower side of the radiative element 12. The narrower side of the grounding element 14 is arranged along the wider side of the radiative element 12.

However, as long as that the grounding element 14 is disposed diagonally relative to the feed element 16, the wider side of the grounding element 14 can also be arranged along the wider side of the radiative element 12 and the narrower side of the grounding element 14 can also be arranged along the narrower side of the radiative element 12.

As shown in FIGS. 2A-C. The grounding element 14 and the feed element 16 are connected to the lower surface of the radiative element 12. However, according to the consideration of design and materials used, the grounding element 14 and the feed element 16 can also be connected to the upper surface of the radiative element 12.

Furthermore, the radiative element 12 has a length L, a width W and a thickness T that respectively range within 10~15 mm, 6~8 mm and 0.2~0.43 mm. The grounding element 14 has a length L1, a width W1 and a height H1 that respectively range within 1~3 mm, 0.2~0.43 mm and 5~7 mm. If the feed element 16 is cylindrical, for example, the feed element 16 is a metal pole, its radius R ranges within 0.3~1 mm. The feed element 16 only needs to connect to the radiative element 12 and its height H is unlimited. The height H of the feed element 16 can be larger or smaller than the height H1 of the grounding element 14. The height H of the feed element 16 can also be the same as the height H1 of the grounding element 14.

Figure 3A:
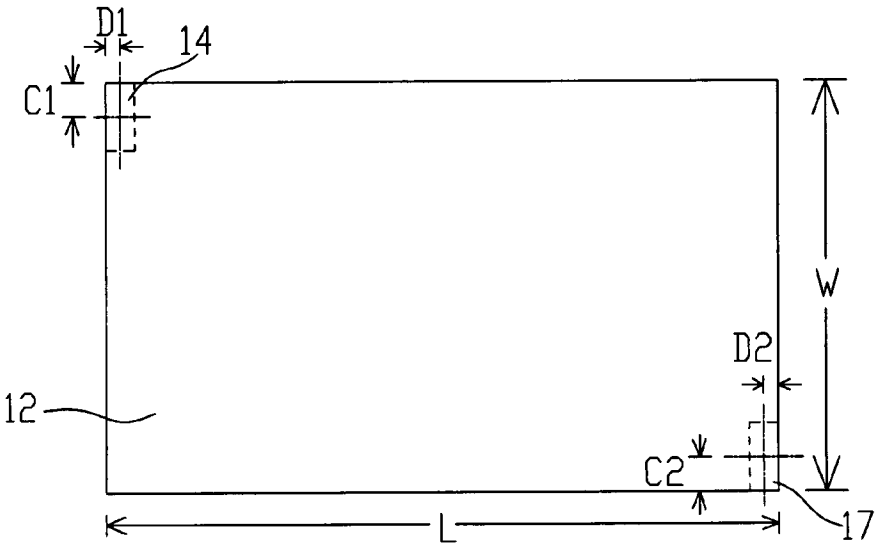
FIG. 3A is a front view of another preferred embodiment in accordance with the present invention.
Figure 3B:
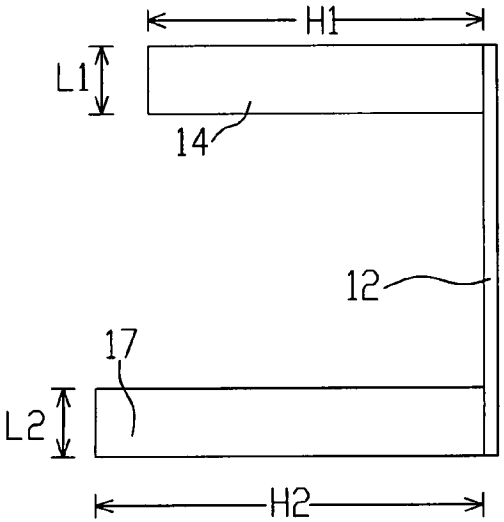
FIG. 3B is a side view of another preferred embodiment in accordance with the present invention.
Figure 3C:
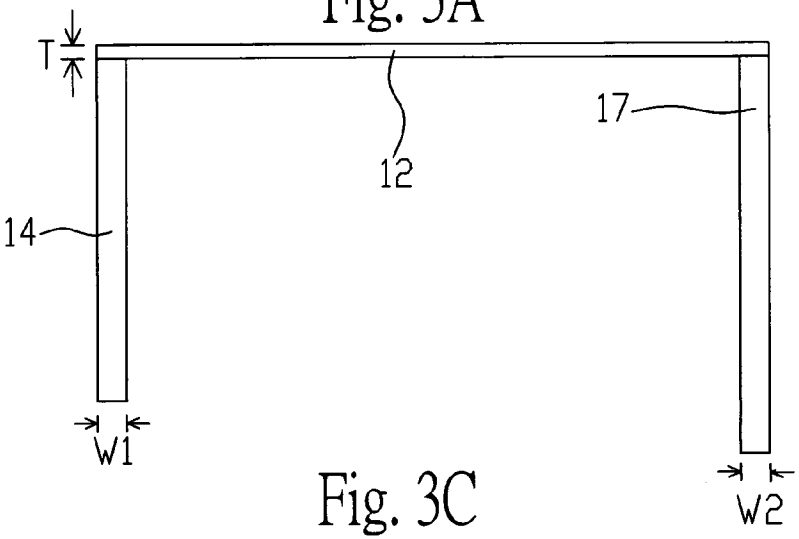
FIG. 3C is a upward view of another preferred embodiment in accordance with the present invention.

Reference is made to FIGS. 3A-C, which are respectively a front view, a side view and an upward view in accordance with another preferred embodiment of the present invention. As shown in these figures, the feed element 17 of this embodiment is different to the feed element 16 of the embodiment mentioned above. The feed element 17 of this embodiment is formed as a strip. It can be, for example, a metal strip. One end of the feed element 17 is connected to an end of the radiative element 12 and the other end of the feed element 17 is connected to a transmission line of a printed circuit board (PCB), such as a micro-strip transmission line, a co-planar waveguide transmission line or a strip-line transmission line. Using a metal strip as the feed element 17 mainly has three advantages as follows.

(1) It can be constructed together with the grounding element 14 and radiative element 12. Hence, making the molds is easy and the consumption of the raw materials and labor are reduced.

(2) It can be easily supported by the ground plane 20 mainly provided by a PCB. Thus, the collapse of the radiative element 12 can be prevented.

(3) It is convenient to connect directly to the any kinds of PCBs to prevent unnecessary transmission loss.

If the feed element 17 is constructed together with the grounding element 14 and radiative element 12, the length L2 of the feed element 17 can ranges within 1~3 mm. The width W2 can ranges within 0.2~0.43 mm. The height H2 is unlimited and it only needs to be sufficient for the feed element 17 to connect to the radiative element 12. As shown in FIGS. 3A-C, if the feed element 17 is a metal strip, it is preferred to connect to another end of the radiative element 12. The end of the feed element 17 connected to the radiative element 12 has a length C2 and a width D2. The length C2 is one half of the normal length L2 of the feed element 17 while the width D2 is one half of the normal width W2 of the feed element 17. The wider side of the feed element 17 is arranged along the narrower side of the radiative element 12. The narrower side of the feed element 17 is arranged along the wider side of the radiative element 12.

However, as long as that the grounding element 14 is disposed diagonally relative to the feed element 17, the wider sides of the grounding element 14 and the feed element 17 can also be arranged along the wider side of the radiative element 12 and the narrower sides of the grounding element 14 and the feed element 17 can also be arranged along the narrower side of the radiative element 12.

Figure 4A:
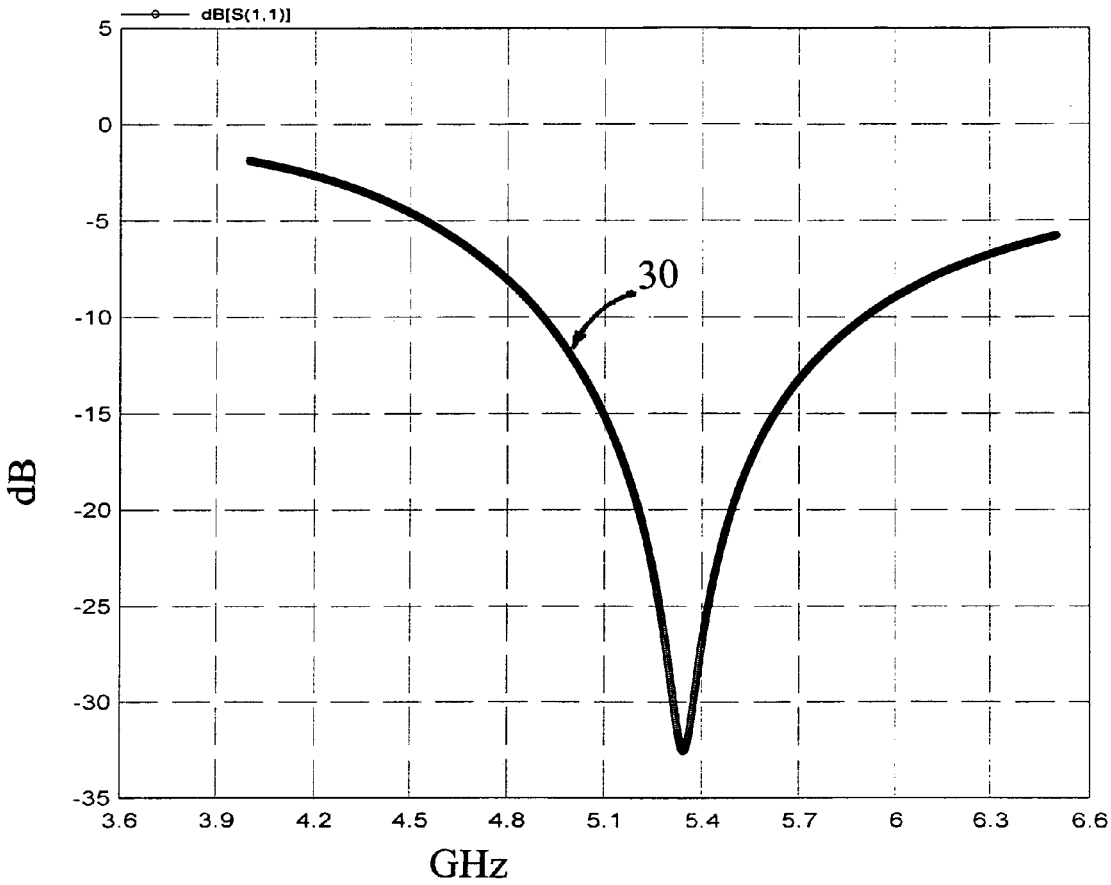
FIG. 4A shows the curve of return loss versus frequency in accordance with the present invention.

Reference is made to FIG. 4A, which shows the curve of return loss versus frequency in accordance with the present invention. According to the curve 30 shown in FIG. 4A, the frequency range for the return loss lower than −10 dB is 4.9 GHz~5.85 GHz. It means that the frequency band of the present invention ranges between 4.9 GHz~5.85 GHz. Thus, the bandwidth of the present invention is larger than that of the conventional antenna. The frequency band of the present invention can cover the frequency bands defined in IEEE820.11a and IEEE820.11j. Furthermore, according to the curve 30, the center frequency of the antenna provided in the present invention is about 5.4 GHz.

Figure 4B:
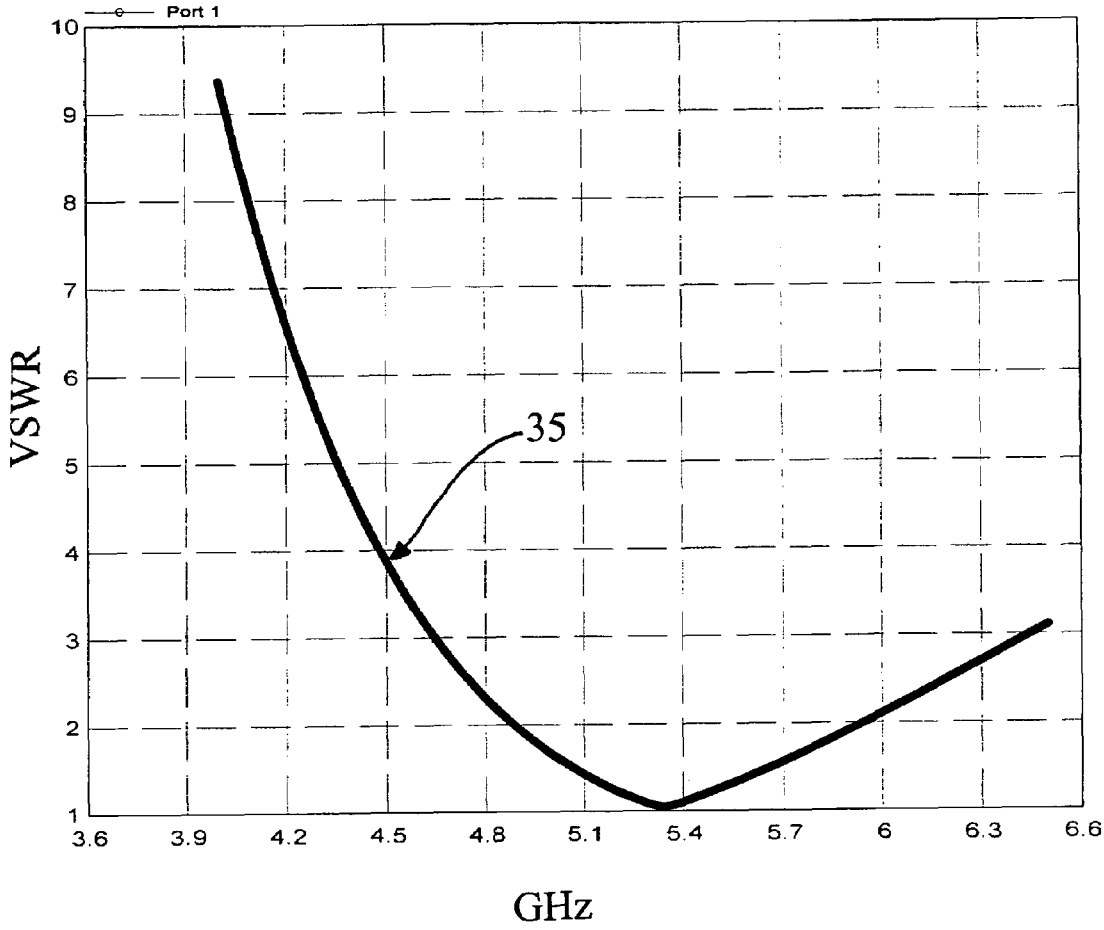
FIG. 4B shows the voltage standing wave ratio (VSWR) of the present invention.

Reference is made to FIG. 4B, which shows the voltage standing wave ratio (VSWR) in accordance with the present invention. The bandwidth of the antenna provided in the present invention can also be known via FIG. 4B. According to the curve 35 shown in FIG. 4B, the frequency range for the voltage standing wave ratio lower than 2 is also 4.9 GHz~5.85 GHz. The center frequency is also about 5.4 GHz.

Figure 5A:
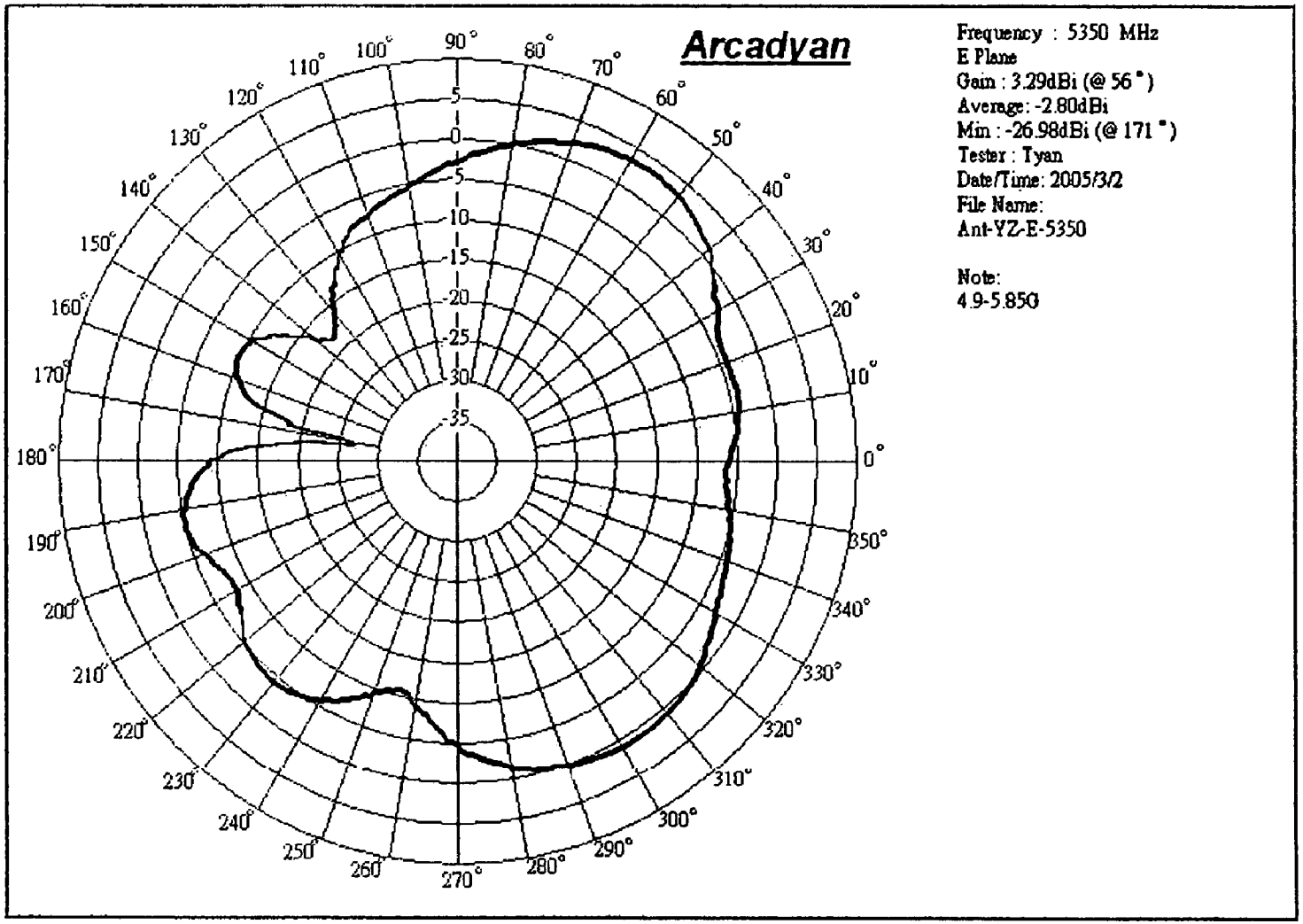
FIG. 5A shows the radiation patterns of E-plane in accordance with the present invention.
Figure 5B:
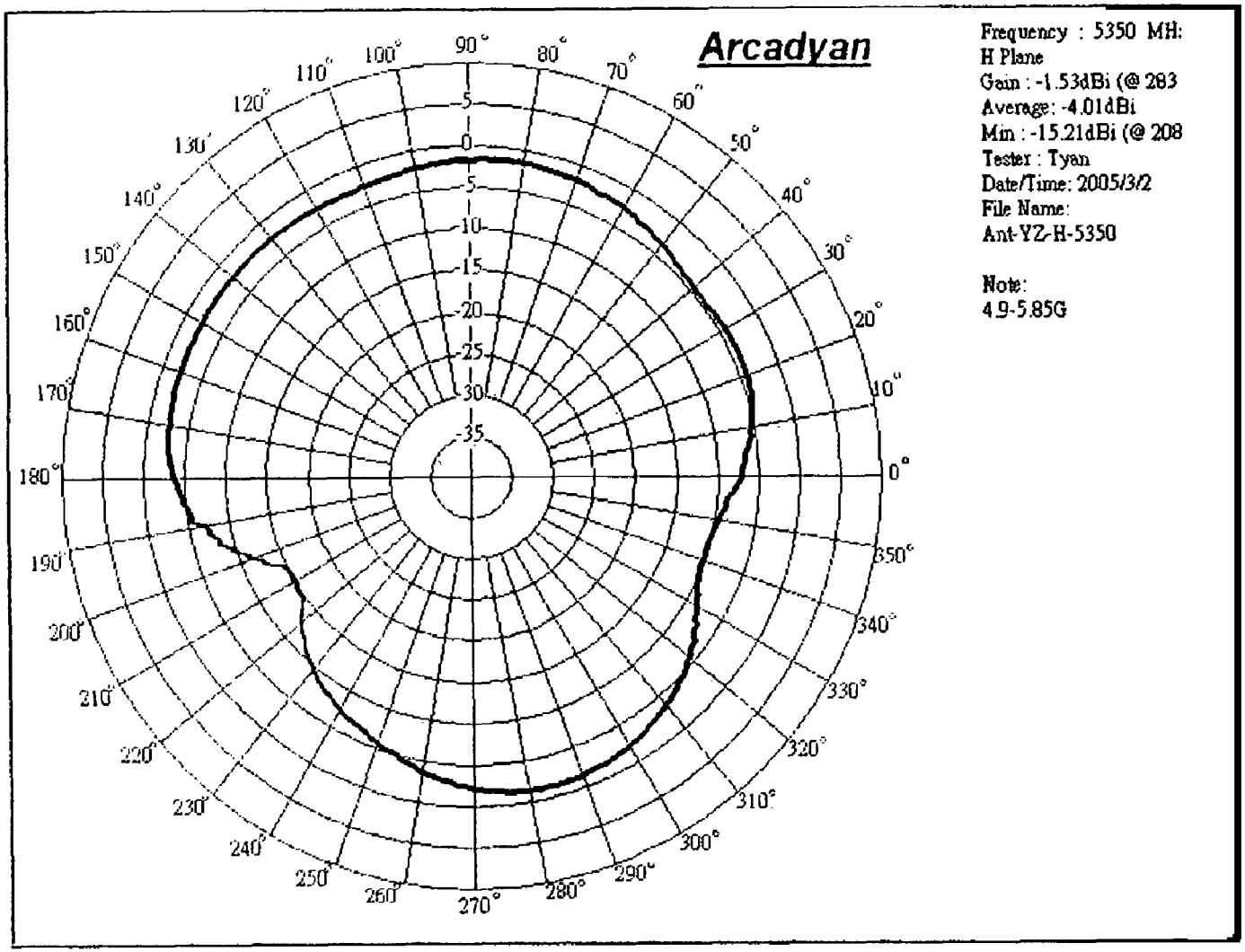
FIG. 5B shows the radiation patterns of H-plane in accordance with the present invention.

Reference is made to FIG. 5A and FIG. 5B, which respectively show the radiation patterns of E-plane and H-plane in accordance with the present invention. When the operating frequency 5.35 GHz is used, the average gains in E-plane and H-plane are −2.8 dBi and −4.01 dBi respectively. It means that, although the present invention makes the bandwidth wider, it can still remain the operating performance. Furthermore, according to FIG. 5A, the minimum gain occurs at 171° and the corresponding gain is −26.98 dBi. The maximum gain occurs at 56° and the corresponding gain is 3.29 dBi. According the radiation pattern of H-plane shown in FIG. 5B, the minimum gain occurs at 208° and the corresponding gain is −15.981 dBi. The maximum gain occurs at 283° and the corresponding gain is −1.53 dBi.

To sum up, the antenna structure of the present invention has a radiative element, which has an end connected to a grounding element. The grounding element is connected to a ground plane. A feed element is connected to another end of the radiative element. The feed element is connected to a transmission line and located diagonally relative to grounding element. In this way, the antenna of the present invention has a larger bandwidth so that the operating performance is improved and the convenience in use of the antenna is increased.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are embraced within the scope of the invention as defined in the appended claims.

What is claimed is:

1. An antenna structure, comprising:

a radiative element having at least two ends;

a grounding element having one end connected to one of the two ends of the radiative element and another end connected to a ground plane; and a feed element having one end connected to another one of the two ends of the radiative element and another end connected to a transmission line, wherein the feed element is formed as a strip having a wider side arranged along a narrower side of the radiative element and a narrower side arranged along a wider side of the radiative element and is disposed diagonally relative to the grounding element.

2. The antenna structure as claimed in claim 1, wherein the radiative element is rectangular.

3. The antenna structure as claimed in claim 2, wherein the radiative element has a length, a width and a thickness that respectively range within 10~15 mm, 6~8 mm and 0.2~0.43 mm.

4. The antenna structure as claimed in claim 1, wherein the grounding element has a length, a width and a height that respectively range within 1~3 mm, 0.2~0.43 mm and 5~7 mm.

5. The antenna structure as claimed in claim 1, wherein the feed element is a metal pole.

6. The antenna structure as claimed in claim 1, wherein the feed element has a length and a width that respectively range within 1~3 mm and 0.2~0.43 mm.

7. The antenna structure as claimed in claim 1, wherein the feed element is a metal strip.

8. The antenna structure as claimed in claim 1, wherein the grounding element has a wider side arranged along a narrower side of the radiative element and a narrower side arranged along a wider side of the radiative element.

9. The antenna structure as claimed in claim 1, further comprising an auxiliary supporting element disposed between the radiative element and the ground plane for auxiliary support of the radiative element.

10. The antenna structure as claimed in claim 9, wherein the auxiliary supporting element has a dielectric constant lower than 1.2 and a dissipation factor lower than 0.01.

11. The antenna structure as claimed in claim 10, wherein the auxiliary supporting element is made of foam.

12. The antenna structure as claimed in claim 1, wherein the transmission line connected to the feed element is a coaxial cable.

13. The antenna structure as claimed in claim 1, wherein the transmission line connected to the feed element is a transmission line of a printed circuit board (PCB).

* * * * *